US006490813B1

(12) United States Patent
Oechsle

(10) Patent No.: US 6,490,813 B1
(45) Date of Patent: Dec. 10, 2002

(54) DRYING AND SMOOTHING UNIT FOR WEBS OF FIBROUS MATERIAL

(75) Inventor: Markus Oechsle, Bartholomae (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/484,446

(22) Filed: Jan. 18, 2000

(30) Foreign Application Priority Data

Jan. 15, 1999 (DE) ..... 199 01 400

(51) Int. Cl.[7] ..... F26B 3/00

(52) U.S. Cl. ..... 34/445; 34/446; 34/454; 162/198; 162/DIG. 6; 162/DIG. 10

(58) Field of Search ..... 34/425, 445, 446, 34/454; 162/DIG. 6, DIG. 10, 198, 263

(56) References Cited

U.S. PATENT DOCUMENTS

| | | | | |
|---|---|---|---|---|
| 3,622,448 A | * | 11/1971 | Adams | 162/DIG. 6 |
| 3,658,642 A | * | 4/1972 | Keyes, IV et al. | 162/DIG. 6 |
| 3,838,000 A | | 9/1974 | Urbas | |
| 3,948,721 A | | 4/1976 | Winheim | |
| 4,378,639 A | | 4/1983 | Walker | |
| 5,557,860 A | | 9/1996 | Kotitschke et al. | |
| 5,592,751 A | | 1/1997 | Guggemos et al. | |
| 5,771,603 A | | 6/1998 | Kotitschke et al. | 34/466 |

FOREIGN PATENT DOCUMENTS

| | | |
|---|---|---|
| DE | 9320455 | 10/1994 |
| DE | 9414963 | 12/1994 |
| DE | 29521501 | 7/1997 |
| EP | 0742313 | 11/1996 |
| GB | 2039014 | 7/1980 |
| WO | 99/25922 | 5/1999 |

OTHER PUBLICATIONS

AdvantagePlus advertisement article describing four channel IR moisture measurement system.

V.I.B. Electronic Control advertisment article describing an electronic system.

ModuleSteam advertisement article describing a steam blast box.

* cited by examiner

*Primary Examiner*—Jiping Lu
(74) *Attorney, Agent, or Firm*—Greenblum & Bernstein, P.L.C.

(57) ABSTRACT

A process and a device for drying and smoothing a web. The process uses an apparatus including at least one dryer section having a plurality of heated cylinders and a calender having a plurality of smoothing nips, and includes guiding the web over the plurality of heated cylinders in the at least one dryer section, drying the web in the at least one dryer section to a maximum dry content of approximately 93%, adjusting a moisture cross-profile of the web in the dryer section, and guiding the web to the calender. The device includes a dryer section comprising beginning, middle, and end sections, a calender, and at least one adjusting device located in the end section for moistening the web, wherein the web is guided through the dryer section prior to being guided to the calender.

33 Claims, 2 Drawing Sheets

DRYING AND SMOOTHING UNIT FOR WEBS OF FIBROUS MATERIAL

CROSS-REFERENCE TO RELATED APPLICATIONS

The present application claims priority under 35 U.S.C. §119 of German Patent Application No. 199 01 400.0, filed on Jan. 15, 1999, the disclosure of which is expressly incorporated by reference herein in its entirety.

BACKGROUND OF THE INVENTION

1. Field of the Invention

The invention relates to processes and the corresponding devices for drying and smoothing a web of fibrous material, particularly a paper web, in a machine for manufacturing and/or finishing such a web, including at least one drier section in which the fibrous material web is conducted through a plurality of heated cylinders and a calendar with a number of smoothing nips.

2. Discussion of Background Information

In order to achieve a moisture cross-profile which is as uniform as possible, fibrous material webs have typically been subjected to intense drying and then moistened again at the end of the drying process. This requires a great deal of energy and long dryer sections.

Conventional SC papers achieve a dry content of, e.g., 97–98% at the end of the dryer section, given a good moisture cross-profile of 2 sigma of approximately 0.15–0.3%. With the application of moisture at the end of the dryer section, the dry content here is reduced to 91–93%. After the paper roll has experienced a "maturation time," during which the moisture content equalizes itself over the thickness of the paper, the paper is fed to a calendar.

To make the manufacturing process more effective, however, there is a growing interest in allowing the calendering process to immediately succeed the drying process. With the elimination of the above-mentioned "maturation time," however, the moisture cross-profile of the fibrous material web worsens, particularly at high speeds.

Here, the moisture cross-profile measured at the end of the dryer section is used to control the treatment device at the end of the dryer section and is also used, if need be, to control any steam-blowing boxes present in a pressing section positioned in front of the dryer section. This method is not only imprecise, but is also associated with long reaction times, which in turn increases the number of rejects.

SUMMARY OF THE INVENTION

The present invention therefore provides for a process for drying and smoothing fibrous material webs. The invention also provides for devices for performing the process. Moreover, the invention allows for calendering to occur immediately following the drying process, particularly at high speeds, while guaranteeing an optimal moisture cross-profile.

The process provides for the fibrous material web in the dryer section to be dried to a dry content of at most approximately 93% and, in the dryer section, the moisture cross-profile of the fibrous material web is influenced a number of times and/or the moisture distribution is made as uniform as possible over the thickness of the fibrous material web by moistening or drying at least one side of the fibrous material web at a plurality of points during the drying process. A jet humidifier or a steam blow box may be used to add the moisture to the web and this device may be located anywhere along the dryer section. Preferably, the influencing device is located towards the end of the dryer section. Moreover, a dryer section having a beginning, middle, and end section should have at least one influencing device in the end section and one or more such devices in the beginning and middle sections.

A significant savings in energy can be achieved by limiting the dry content of the fibrous material web in the dryer section, which preferably will equal a maximum of approximately 91%.

The assurance of a good and uniform moisture cross-profile, as viewed crosswise to the fibrous material web, is achieved with the treatment of the fibrous material web at a plurality of points within the dryer section.

Furthermore, a relatively uniform moisture distribution over the thickness of the fibrous material web during the drying process is advantageous in that limited moistening or drying at the end of the dryer section is sufficient. Consequently, achieving a good moisture cross-profile also does not require excessive drying.

The invention allows at least the moisture distribution over the thickness of the fibrous material web and/or the moisture cross-profile in the first two thirds of the dryer section to be influenced. It is most important for the influencing device (e.g., a jet humidifier or a steam blow box) to be at least applied in the last third of the dryer section. An additional device can also be located between the dryer section and the calender. In agreement with this suggested configuration of the points of influence, but also independent of them, it can be advantageous for influence to be exerted at a moisture content of between approximately 50% and 15%, preferably between approximately 25% and 15%, and, furthermore, at a moisture content of between approximately 20% and 8%, preferably between approximately 15% and 8%.

As a result of controlling good moisture distribution, and/or a good moisture cross-profile at the end of the dryer section, it is possible for the fibrous material web to pass through the dryer section and the calender at a speed of more than approximately 1200 m/min, preferably more than approximately 1500 m/min. It is of special advantage here for the fibrous material web to be heated and to be pressed and steamed across the width of the web in a manner that permits control according to zone.

The intensity of moistening or drying should be adjustable at several points, so as to influence the moisture cross-profile according to zones across the width of the fibrous material web. In each case, the zones should be adjusted on the basis of the subsequent measurement of the moisture cross-profile. The zone widths should be as small as possible and less than approximately 50 mm, preferably less than approximately 25 mm.

The corresponding device provides for at least one influencing device to be assigned to the fibrous material web in at least one of the first two thirds of the dryer section, as well as in the last third of the dryer section, and in the area between the dryer sections and the calender; and/or that at least one influencing device is assigned to the fibrous material web in an area in which it has a moisture content between approximately 50% and 15%, preferably between approximately 25% and 15%, and in at least one area in which it has a moisture content between approximately 20% and 8%, preferably between approximately 15% and 8%. As an end result, at least two influencing devices are employed, i.e., one in the end section and another at any location described above.

To assure as fine a water distribution as possible, the influencing devices (i.e., jet humidifiers) for moistening, particularly in the last third of the dryer section, should spray water on the fibrous material web with as small a droplet size as possible, in range of less than approximately 100 $\mu$m, preferably less than approximately 80 $\mu$m.

Furthermore, the quotient of the length of the fibrous material web between the last point at which the moisture distribution over the thickness of the web is influenced and/or the moisture cross-profile is influenced, particularly by moistening, and the first smoothing nip of the adjacent calender divided by the speed of the fibrous material web should amount to at least approximately one second. This provides a minimal penetration time and allows the sprayed water to penetrate the fibrous material web up to the beginning of the smoothing process.

Assigned to the influencing devices here are moisture cross-profile measuring units which help control the influencing devices.

To assure a quick reaction time, or optimal control, each influencing device should have a moisture cross-profile measuring unit assigned to it whenever possible, preferably positioned after it in the direction of flow.

It is also possible to provide several moisture cross-profile measuring units and to assign one or two influencing devices to each moisture cross-profile measuring unit.

The moisture distribution over the thickness and width of the fibrous material web can be advantageously further influenced if one of the pressing sections located in front of the dryer section and employed for removing water contains at least one steam-blowing box for the purpose of heating the web that runs at a right angle to the fibrous material web and can be controlled according to zones.

To achieve good values for luster and smoothness in the fibrous material web, it is essential for the calender to include at least three smoothing rollers which, taken in pairs, form one smoothing nip; here, at least one smoothing roller is heated and at least one smoothing roller can be controlled with respect to bending. Moistening within the calender can also improve the result; heating and/or moistening (primarily with steam) will preferably be controlled according to zone.

In the dryer section in which, for the most part, only one side of the fibrous material web comes into contact with heated cylinders, it is generally sufficient for influencing devices to be predominantly assigned only to this one side of the web, preferably for moistening. Assigning at least one influencing device to each side of the fibrous material web may only be necessary in the last third of the dryer section in order to dry the outer areas of the fibrous material web.

If both sides of the fibrous material web come into contact with heated cylinders to any significant degree, then both sides should be assigned influencing devices for moistening.

The invention provides a process for drying and smoothing a web in an apparatus including at least one dryer section having a plurality of heated cylinders and a calender having a plurality of smoothing nips, the process including guiding the web over the plurality of heated cylinders in the at least one dryer section, drying the web in the at least one dryer section to a maximum dry content of approximately 93%, adjusting a moisture cross-profile of the web in the dryer section, and guiding the web to the calender. The web may be a fibrous material paper web. The web may be dried to a dry content of approximately 91%. The process may further include adjusting a moisture distribution over a thickness of the web during the drying by moistening at least one side of the web. The moistening may include a plurality of moistening points which provide the web with approximately uniform moisture content. The adjusting may further include influencing the moisture cross-profile within a first two thirds of the dryer section, and influencing the moisture cross-profile in a last third of the dryer section. The adjusting may include influencing the moisture cross-profile within a first two thirds of the dryer section, and influencing the moisture cross-profile between the dryer section and the calender. The adjusting further may include influencing the moisture cross-profile within a first two thirds of the dryer section, and influencing the moisture cross-profile in a last third of the dryer section and between the dryer section and the calender. The adjusting may include influencing the web moisture cross-profile at a point where the web has a moisture content between approximately 50% and 15%. The moisture content is between approximately 25% and 15%. The adjusting may also include influencing the web moisture cross-profile at a point where the web has a moisture content between approximately 20% and 8%. The moisture content is between approximately 15% and 8%. The guiding may include running the web through the dryer section at a speed greater than approximately 1200 m/min. The running may be at a speed greater than approximately 1500 m/min. The guiding may include allowing the web to absorb moisture for at least one second after influencing and before the web enters the calender. The guiding may include heating the web in the calender and pressing the web over its width according to controllable zones. The adjusting may provide for influencing the moisture cross-profile of a plurality of zones across the width of the web. The adjusting of each zone may be continuous. The adjusting may further include measuring the moisture cross-profile of the web using at least one measurement device. The measuring may be performed at a point which is ahead of a point of adjusting. The measuring may be performed by zone. The adjusting may be performed by zone. Each zone may be adjusted in response to a corresponding zone measurement. Each zone may be continuously adjusted in response to a corresponding continuous zone measurement.

According to another aspect of the invention, there is provided a device for drying and smoothing a web, including a dryer section comprising beginning, middle, and end sections, a calender, and at least one adjusting device located in the end section for moistening the web, wherein the web is guided through the dryer section prior to being guided to the calender. The device may further include at least one adjusting device disposed in one of the beginning and the middle sections for moistening the web. One of the adjusting devices may be located in a section where the web has a moisture content between approximately 50% and 15%. The moisture content may be between approximately 25% and 15%. Another adjusting device may be located in a section where the web has a moisture content between approximately 20% and 8%. The moisture content may be between approximately 15% and 8%. At least one adjusting device may be located in each of the beginning and middle sections. The at least one adjusting device may moisten the web with a fine mist spray. The fine mist spray may be water. The fine mist spray may have droplets which are in a range less than approximately 100 $\mu$m. The droplets may be in the range of less than approximately 80 $\mu$m. The device may also include a plurality of adjusting devices for moistening the web in zones. The plurality of zones may be arranged across the width of the web so as to define a zone moistening width. Each zone may be moistened by a corresponding adjusting device. Each zone moistening width may be less than approximately 25 mm. Each zone moistening width is less than approximately 15 mm. At least one moisture cross-profile measuring unit for influencing the at least one adjusting device can be included. The device can also include a plurality of moisture cross-profile measuring units, and a plurality of adjusting devices, wherein each measuring unit influences a corresponding adjusting device. The measuring units may comprise infrared measuring devices. Each infrared measuring unit can control a amount of water delivered to the web by each corresponding adjusting device. Each adjusting device may deliver water to a specific zone width of the web. Each adjusting device may be located along a web travel path such that it is followed by a corresponding moisture cross-profile measuring unit. The device may further have a plurality of moisture cross-profile measuring units, and a plurality of adjusting devices, wherein each measuring unit influences a corresponding adjusting device and wherein at least one measuring unit influences at least two adjusting devices. The at least one measuring unit which influences the at least two adjusting devices may be located in the end section. The device may utilize at least one steam-blowing box located ahead of a press nip, wherein the press nip is located before the dryer section. The at least one steam-blowing box comprises a device for heating the web. The at least one steam-blowing box comprises a moisture removing device. The calender may further include at least three smoothing nips arranged in pairs with at least one roller of each pair comprising a heated roller and at least one opposing roller of each pair comprising a bending roller. The dryer section may further include a plurality of heated cylinders, and the at least one influencing device positioned downstream of one of the heated cylinders, wherein the web is moistened by the at least one adjusting device after it is heated by one of the heated cylinders. The device may have at least one aspirating cylinder located downstream from one of the heated cylinders, wherein the at least one adjusting device is located adjacent the at least one aspirating cylinder. The device may also employ the at least one adjusting device being located on one side of the web so as to moisten this one side. The at least one adjusting device may be located on each side of the web so as to moisten the web from both sides. The at least one adjusting device may be at least two adjusting devices of each being located on each side of the web so as to moisten the web from both sides, wherein these adjusting devices are each positioned in end section. The dryer section may have a plurality of heated cylinders, and at least two influencing devices positioned downstream of one of the heated cylinders, wherein the web is moistened by from each side by at least one influencing device after it is heated by one of the heated cylinders. The heated cylinders may be arranged so as to heat both sides of the web.

According to still another aspect of the invention, there is provided a process for drying and smoothing a web, including guiding the web through at least one nip press, guiding the web through at least one dryer section, said dryer section comprising a beginning, middle, and end section wherein the at least one dryer section further comprises a plurality of heated cylinders, measuring a moisture cross-profile of the web with a measurement device located in one of the middle section and the end section, adjusting a moisture cross-profile of the web in one of the beginning, middle, and end section based upon the measuring, and drying the web in the at least one dryer section to a maximum dry content of approximately 93%, further guiding the web to a calender comprising a plurality of smoothing nips.

The invention also provides for a device for drying and smoothing a web, including a first nip press, a dryer section comprising beginning, middle, and end sections, said dryer section further comprising a plurality of heated cylinders, at least one adjusting device for moistening the web located in the end section and at least one of the beginning and middle sections, at least one measuring device located downstream from one of the at least one adjusting device for measuring the moisture cross-profile of the web, and a calender section comprising a plurality if nip presses, wherein the web is guided from the first nip press, through the dryer section, and through the calender section and wherein the moisture cross-profile of the web is adjusted continuously based upon a measured cross-profile.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted drawings by way of a non-limiting examples of exemplary embodiments of the present invention, and wherein.

DETAILED DESCRIPTION OF THE PRESENT INVENTION

Figure 1:
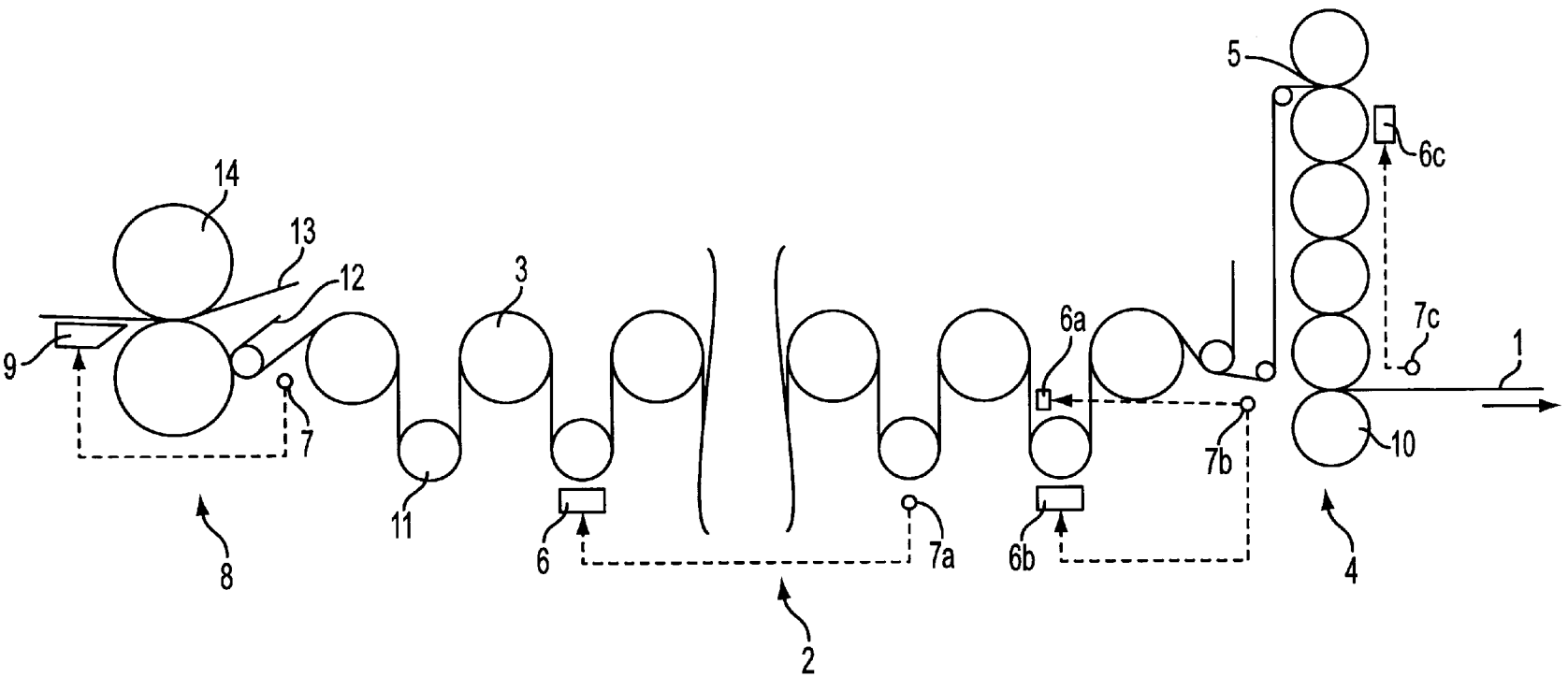
FIG. 1 shows a schematic depiction of a press and dryer section, as well as a calender.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

In press section 8, fibrous material web 1, together with at least one press felt 13, passes through at least one press nip formed by two press rolls 14. Press felt 13 absorbs the squeezed out water and removes it from fibrous material web 1. Fibrous material web 1 then reaches dryer section 2, which includes a plurality of drier groups in which fibrous material web 1, together with a drying sieve 12, runs alternately over heated cylinders 3 and, preferably, aspirated guiding rollers 11. In the process, the lower side of fibrous material web 1 is in contact with heated cylinders 3 and drying sieve 12 is in contact with guiding rolls 11.

After passing through dryer section 2, fibrous material web 1 is conducted to a calender 4 which provides fibrous material web 1 with characteristics of luster and smoothness.

Calender 4 includes, e.g., six smoothing rolls 10 positioned one above the other, which, taken in pairs, form five smoothing nips 5 between adjacent smoothing rolls in which one of the two adjacent smoothing rolls is heated and the other is controlled (or adjusted) with respect to bending.

Located in press section 8 is a steam-blow box 9 which, cross-wise to the fibrous material web travel path, can be controlled according to zones and which influences the moisture cross-profile of fibrous material web 1 in this respect. To this end, a moisture cross-profile measuring unit 7 is positioned and used for influencing steam-blow box 9, and may be ideally positioned at the beginning of dryer section 2. Also positioned near the beginning of dryer section 2 is an influencing device 6 assigned to the heated lower side of fibrous material web 1. Located at the end of dryer section 2 are two other influencing devices 6*a* and 6*b* which also apply moisture to the web. Each of influencing devices 6*a* and 6*b* are preferably positioned on different sides of fibrous material web 1 as shown. Dryer section 2 influencing devices 6, 6*a*, 6*b* can be controlled according to zone, wherein the zone width is preferably equal to approximately 25–35 mm. Influencing devices 6, 6*a*, 6*b* can also produce sprayed water droplets of less than approximately 100 $\mu$m. Moreover, each of these devices are influenced by moisture cross-profile measuring units 7*a* and 7*b*, which are preferably positioned ahead of their corresponding influencing devices. For example, whereas the moisture cross-profile measuring unit 7*a* of first influencing device 6 is positioned in front of influencing devices 6*a*, 6*b*, influencing devices 6*a*, 6*b*, of dryer section 2 may utilize a joint moisture cross-profile measuring device 7*b*, which may preferably be located between dryer section 2 and calender 4. Thus, the invention contemplates the use of one or many influencing devices which can be utilized in various locations in the dryer section and the calender and on either side of the web. As an alternative, steam blow box 9 can be replaced with a jet humidifier.

In addition, the possibility exists of further influencing the moisture cross-profile, and thus the luster and smoothness in calender 4, by utilizing still another influencing device 6*c* and a subsequent moisture cross-profile measuring unit 7*c*. These would be substantially similar in design and function as those previously described.

After leaving the calender, fibrous material web 1 may be wound and/or further processed in the conventional manner.

Other embodiments of dryer section 2 are also possible in which, for example, both sides of fibrous material web 1 come into contact with heated cylinders 3, at least in the terminal area of dryer section 2. In these cases, additional influencing devices may be conveniently positioned on both sides of fibrous material web 1 so that they can apply moisture to both sides of fibrous material web 1.

The invention permits web processing speeds of more than approximately 1500 m/min, while influencing devices 6, 6*a*, 6*b* within dryer section 2 are strategically positioned in a moisture content range between approximately 40% and 20% at the beginning of dryer section 2 and between approximately 15% and 10% at the end of dryer section 2. In principle, even more influencing devices 6 can be employed within dryer section 2.

In order to appreciate the scale of the invention in this instance, one should recognize that the length of fibrous material web between influencing device 6*b* for applying moisture and first smoothing nip 5 might equal, e.g., approximately 30 m, which would permit sufficient penetration of the water into fibrous material web 1 before it is subjected to smoothing.

The invention also provides for continuous influence to be exerted on the moisture cross-profile. Furthermore the invention allows the moisture distribution over the thickness of the fibrous material web 1 to be controlled in a manner that reduces the need for excessive drying in dryer section 2.

As a result, dry contents of a maximum of approximately 93% or, as the case may be, approximately 91%, are sufficient, which results in energy savings and shortens the length of dryer section 2.

Figure 2:
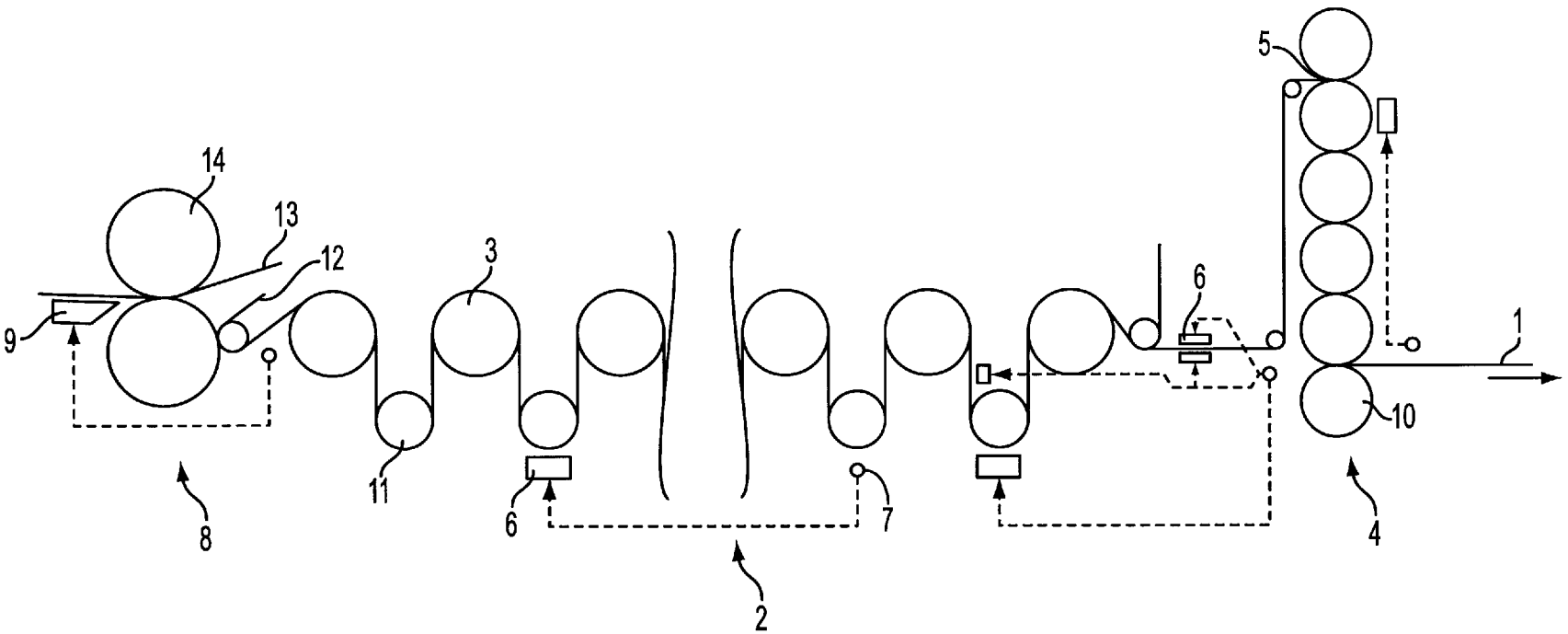
FIG. 2 shows a schematic depiction of another embodiment of a press and dryer section, as well as a calender.

FIG. 2 shows a similar configuration to that of FIG. 1 except that an influencing device 6 is also located between dryer section 2 and calender 4. Moreover, this figure also shows how influencing devices 6 may be located on both sides of the web and again controlled by a single measuring device.

It should also be noted that the measurement of the moisture cross-profile can be performed in a known manner, for example, with infrared technology and the reflection process. A preferred system is the AdvantagePlus® of Voith Sulzer which is expressly incorporated by reference herein. As noted above, the devices for adding moisture to the web can be either jet humidifiers or steam blast boxes or a combination of both types. In this regard, the jet humidifiers may be preferred. Moreover, an electronic control system may be utilized which receives inputs from the various measurement devices and activates or controls the influencing or adjusting devices. Such as system can be, for example, a V.I.B. electronic control system.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A process for drying and smoothing a web in an apparatus including at least one dryer section having a plurality of heated cylinders and a calender having a plurality of smoothing nips, the process comprising:

guiding the web over the plurality of heated cylinders in the at least one dryer section;

drying the web in the at least one dryer section to a maximum dry content of approximately 93%;

measuring a moisture cross-profile in an end section of the at least one dryer section and at least another position in the at least one dryer section before the end section;

adjusting a moisture cross-profile of the web in the at least one dryer section; and guiding the web to the calender.

2. The process of claim 1, wherein the web is a fibrous material paper web.

3. The process of claim 1, wherein the web is dried to a dry content of approximately 91%.

4. The process of claim 1, further comprising:

adjusting a moisture distribution over a thickness of the web during the drying by moistening at least one side of the web.

5. The process of claim 4, wherein the moistening comprises a plurality of moistening points which provide the web with approximately uniform moisture content.

6. The process of claim 1, wherein the adjusting further comprises:

influencing the moisture cross-profile within a first two thirds of the dryer section; and influencing the moisture cross-profile in a last third of the dryer section.

7. The process of claim 1, wherein the adjusting further comprises:

influencing the moisture cross-profile within a first two thirds of the dryer section; and influencing the moisture cross-profile between the dryer section and the calender.

8. The process of claim 1, wherein the adjusting further comprises:

influencing the moisture cross-profile within a first two thirds of the dryer section; and influencing the moisture cross-profile in a last third of the dryer section and between the dryer section and the calender.

9. The process of claim 1, wherein the adjusting comprises influencing the web moisture cross-profile at a point where the web has a moisture content between approximately 50% and 15%.

10. The process of claim 9, wherein the moisture content is between approximately 25% and 15%.

11. The process of claim 1, wherein the adjusting comprises influencing the web moisture cross-profile at a point where the web has a moisture content between approximately 20% and 8%.

12. The process of claim 11, wherein the moisture content is between approximately 15% and 8%.

13. The process of claim 1, wherein the guiding comprises running the web through the dryer section at a speed greater than approximately 1200 m/min.

14. The process of claim 13, wherein the running comprises a speed greater than approximately 1500 m/min.

15. The process of claim 1, wherein the guiding comprises allowing the web to absorb moisture for at least one second after influencing and before the web enters the calender.

16. The process of claim 1, wherein the guiding comprises:

heating the web in the calender and pressing the web over its width according to controllable zones.

17. The process of claim 1, wherein the adjusting comprises influencing the moisture cross-profile of a plurality of zones across the width of the web.

18. The process of claim 17, wherein the adjusting of each zone is continuous.

19. The process of claim 1, wherein the adjusting further comprises:

measuring the moisture cross-profile of the web using at least one measurement device.

20. The process of claim 19, wherein the measuring is performed at a point which is ahead of a point of adjusting.

21. The process of claim 19, wherein the measuring is performed by zone.

22. The process of claim 21, wherein the adjusting is performed by zone.

23. The process of claim 22, wherein each zone is adjusted in response to a corresponding zone measurement.

24. The process of claim 22, wherein each zone is continuously adjusted in response to a corresponding continuous zone measurement.

25. A process for drying and smoothing a web, comprising:

guiding the web through at least one nip press;

guiding the web through at least one dryer section, said at least one dryer section comprising a beginning, middle, and end section wherein the at least one dryer section further comprises a plurality of heated cylinders;

measuring a moisture cross-profile of the web with a measurement device located in the end section;

measuring a moisture cross-profile of the web with another measurement device located in at least one of the beginning section and the middle section;

adjusting a moisture cross-profile of the web in one of the beginning, middle, and end section based upon the measuring; and drying the web in the at least one dryer section to a maximum dry content of approximately 93%;

further guiding the web to a calender comprising a plurality of smoothing nips.

26. A process for drying and smoothing a web in an apparatus including at least one dryer section having a plurality of heated cylinders and a calender having a plurality of smoothing nips, the process comprising:

guiding the web on a single support over the plurality of heated cylinders in the at least one dryer section;

drying the web in the at least one dryer section to a maximum dry content of approximately 93%;

measuring a moisture cross-profile in at least one position in the at least one dryer section, the at least one position being located adjacent at least one of the heated cylinders and on a side of the web which contacts the at least one heated cylinder;

adjusting a moisture cross-profile of the web in the at least one dryer section; and guiding the web to the calender.

27. A process for drying and smoothing a web in an apparatus including at least one dryer section having a plurality of heated cylinders and a calender having a plurality of smoothing nips, the process comprising:

guiding the web over the plurality of heated cylinders in the at least one dryer section;

drying the web in the at least one dryer section to a maximum dry content of approximately 93%;

measuring a moisture cross-profile in an end section of the at least one dryer section;

measuring a moisture cross-profile in at least another position in the at least one dryer section before the end section, the other position being located adjacent at least one of the heated cylinders and on a side of the web which contacts the at least one heated cylinder;

adjusting a moisture cross-profile of the web in the at least one dryer section; and guiding the web to the calender.

28. A process for drying and smoothing a web in an apparatus including at least one dryer section having a plurality of heated cylinders and a calender having a plurality of smoothing nips and at least one heated roller, the process comprising:

guiding the web over the plurality of heated cylinders in the at least one dryer section;

drying the web in the at least one dryer section to a maximum dry content of approximately 93%;

measuring a moisture cross-profile in an end section of the at least one dryer section;

adjusting a moisture cross-profile of the web in the at least one dryer section;

guiding the web to the calender;

measuring a moisture cross-profile after the at least one dryer section; and adjusting a moisture cross-profile of the web in the calender, wherein the web passes through the at least one dryer section and the calender at a speed of more than approximately 1200 m/min.

29. A process for drying and smoothing a web in an apparatus including at least one dryer section having a plurality of heated cylinders and a calender having a plurality of smoothing nips, the process comprising:

guiding the web over the plurality of heated cylinders in the at least one dryer section;

drying the web in the at least one dryer section to a maximum dry content of approximately 93%;

adjusting a moisture cross-profile of the web in the at least one dryer section;

guiding the web to the calender; and passing the web through the at least one dryer section and the calender at a speed of more than approximately 1200 m/min, wherein the adjusting comprises influencing the moisture cross-profile of a plurality of zones across the width of the web.

30. A process for drying and smoothing a web in an apparatus including at least one dryer section having a plurality of heated cylinders and a calender having a plurality of smoothing nips, the process comprising:

guiding the web over the plurality of heated cylinders in the at least one dryer section;

drying the web in the at least one dryer section to a maximum dry content of approximately 93%;

adjusting a moisture cross-profile of the web in the at least one dryer section; and guiding the web to the calender, wherein the web passes through the at least one dryer section and the calender at a speed of more than approximately 1200 m/min.

31. A process for drying and smoothing a web in an apparatus including at least one dryer section having a plurality of heated cylinders and a calender having a plurality of smoothing nips, the process comprising:

guiding the web over the plurality of heated cylinders in the at least one dryer section;

drying the web in the at least one dryer section to a maximum dry content of approximately 93%;

adjusting a moisture cross-profile of the web in the at least one dryer section;

influencing at least a moisture distribution over a thickness of the web in the at least one dryer section; and guiding the web to the calender, wherein the web passes through the at least one dryer section and the calender at a speed of more than approximately 1200 m/min.

32. A process for drying and smoothing a web in an apparatus including at least one dryer section having a plurality of heated cylinders and a calender having a plurality of smoothing nips, the process comprising:

guiding the web over the plurality of heated cylinders in the at least one dryer section;

drying the web in the at least one dryer section to a maximum dry content of approximately 93%;

adjusting a moisture cross-profile of the web in the at least one dryer section;

influencing, in a first two thirds of the at least one dryer section, at least one of the moisture cross-profile of the web and a moisture distribution over a thickness of the web; and guiding the web to the calender, wherein the web passes through the at least one dryer section and the calender at a speed of more than approximately 1200 m/min.

33. A process for drying and smoothing a web in an apparatus including at least one dryer section having a plurality of heated cylinders and a calender having a plurality of smoothing nips, the process comprising:

guiding the web over the plurality of heated cylinders in the at least one dryer section;

drying the web in the at least one dryer section to a maximum dry content of approximately 93%;

adjusting a moisture cross-profile of the web in the at least one dryer section;

influencing at least the moisture cross-profile of the web in a first two thirds of the at least one dryer section; and guiding the web to the calender, wherein the web passes through the at least one dryer section and the calender at a speed of more than approximately 1200 m/min.

* * * * *